US008075152B2

(12) United States Patent
Chen et al.

(10) Patent No.: US 8,075,152 B2
(45) Date of Patent: Dec. 13, 2011

(54) HERMETIC LIGHT-EMITTING DEVICE

(75) Inventors: Yao Shun Chen, Xinpu Township, Hsinchu County (TW); Ra Min Tain, Jhonghe (TW)

(73) Assignee: Industrial Technology Research Institute, Chutung, Hsinchu (TW)

( * ) Notice: Subject to any disclaimer, the term of this patent is extended or adjusted under 35 U.S.C. 154(b) by 58 days.

(21) Appl. No.: 12/762,461

(22) Filed: Apr. 19, 2010

(65) Prior Publication Data

US 2011/0103059 A1 May 5, 2011

(30) Foreign Application Priority Data

Oct. 29, 2009 (TW) ..... 98219963 U

(51) Int. Cl.
*F21S 4/00* (2006.01)

(52) U.S. Cl. ..... 362/101; 362/249.02; 362/249.11; 362/800

(58) Field of Classification Search ..... 362/249.02, 362/249.11, 800, 101
See application file for complete search history.

(56) References Cited

U.S. PATENT DOCUMENTS 6,161,910 A 12/2000 Reisenauer et al.
6,364,507 B1 * 4/2002 Yang ..... 362/248
7,081,645 B2 7/2006 Chen et al.
7,338,186 B1 3/2008 Wu et al.
7,347,589 B2 3/2008 Ge
7,674,011 B2 * 3/2010 Zhou et al. ..... 362/249.02
7,712,923 B2 * 5/2010 Huang et al. ..... 362/267
7,744,236 B2 * 6/2010 Hsu et al. ..... 362/101
7,810,950 B2 * 10/2010 Zhou et al. ..... 362/249.02
7,841,740 B2 * 11/2010 Zhou et al. ..... 362/249.02
7,914,183 B2 * 3/2011 Yang et al. ..... 362/373
2005/0068776 A1 3/2005 Ge

* cited by examiner

*Primary Examiner* — Anabel Ton
(74) *Attorney, Agent, or Firm* — Egbert Law Offices PLLC

(57) ABSTRACT

A hermetic light-emitting device includes a heat dissipation member including a first surface, a second surface and a first through-hole formed between the first and second surfaces. A circuit substrate has a plurality of conductive traces and a second through-hole disposed corresponding to the first through-hole. A light-emitting element is disposed on the circuit substrate and electrically connected to the plurality of conductive traces. A plurality of electrical wires pass through the first and second through-holes and connect to the plurality of conductive traces to externally supply electrical power to the light-emitting element. A sealing material fills the first and second through-holes. A seal pad member includes a pad opening and is disposed on the first surface of the heat dissipation member and surrounding the circuit substrate. A cover member is disposed over the light-emitting element and against the seal pad member.

20 Claims, 3 Drawing Sheets

HERMETIC LIGHT-EMITTING DEVICE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present disclosure relates to a light-emitting device, and relates more particularly to a hermetic light-emitting device.

2. Description of Related Art Including Information Disclosed Under 37 CFR 1.97 and 37 CFR 1.98

Light emitting diodes are being adopted by an increasing number of manufacturers, to be used as light sources for different light-emitting devices in place of conventional light-emitting devices.

In addition to providing sufficient illumination, light-emitting diode devices adapted for an outdoor environment have to be completely airtight or waterproof. A commercially available light-emitting diode device includes a light-emitting diode module connected to an external power supply using conductive wires. Due to the passage of the conductive wires through sealing means, the original hermetic sealing of the light-emitting diode device may be compromised, and thus the light-emitting diode device may not be completely airtight or waterproof.

For different outdoor locations, the illumination requirements of a light-emitting device are different. Usually, to meet different requirements of illumination, different light-emitting diode devices need to be designed and manufactured. Specialized development and manufacture of different light-emitting diode devices may increase cost, adversely affecting the popularization of light-emitting diode devices.

Therefore, commercially available light-emitting diode devices need improvements.

BRIEF SUMMARY OF THE INVENTION

One embodiment of the present disclosure provides a hermetic light-emitting device, which comprises a heat dissipation member, a circuit substrate, at least one light-emitting element, a plurality of electrical wires, a sealing material, a seal pad member, and a cover member. The heat dissipation member includes a first through-hole, at least one fin member, a first surface, and a second surface opposite to the first surface, wherein the at least one fin member is disposed on the second surface, and the first through-hole is formed between the first surface and the second surface. The circuit substrate includes a plurality of conductive traces and a second through-hole disposed corresponding to the first through-hole. The at least one light-emitting element is disposed on the circuit substrate and electrically connected to the plurality of conductive traces, wherein the circuit substrate is disposed adjacent to the first surface of the heat dissipation member with the at least one light-emitting element positioned opposite to the heat dissipation member. The plurality of electrical wires pass through the first and second through-holes and are electrically connected to the plurality of conductive traces so as to externally supply electrical power to the at least one light-emitting element. The sealing material fills the first and second through-holes. The seal pad member includes a pad opening and is disposed on the first surface of the heat dissipation member, wherein the circuit substrate is disposed in the pad opening. The cover member is disposed over the at least one light-emitting element and against the seal pad member.

Another embodiment of the present disclosure provides a hermetic light-emitting device, which includes a heat dissipation member, a circuit substrate, at least one light-emitting element, a plurality of electrical wires, a sealing material, and a frame member. The heat dissipation member includes a first through-hole, at least one fin member, a first surface, and a second surface opposite to the first surface, wherein the at least one fin member is disposed on the second surface, and the first through-hole is formed between the first surface and the second surface. The circuit substrate includes a plurality of conductive traces and a second through-hole, which is disposed corresponding to the first through-hole. The at least one light-emitting element is disposed on the circuit substrate and is electrically connected to the plurality of conductive traces, wherein the circuit substrate is disposed adjacent to the first surface of the heat dissipation member with the at least one light-emitting element positioned opposite to the heat dissipation member. The plurality of electrical wires pass through the first and second through-holes and electrically connect to the circuit substrate so as to externally supply electrical power to the at least one light-emitting element. The sealing material fills the first and second through-holes. The frame member includes a frame opening and is disposed on the first surface of the heat dissipation member, wherein the circuit substrate is disposed in the frame opening.

To better understand the above-described objectives, characteristics and advantages of the present disclosure, embodiments, with reference to the drawings, are provided for detailed explanations.

BRIEF DESCRIPTION OF THE SEVERAL VIEWS OF THE DRAWINGS

The disclosure will be described according to the appended drawings in which.

DETAILED DESCRIPTION OF THE INVENTION

Figure 1:
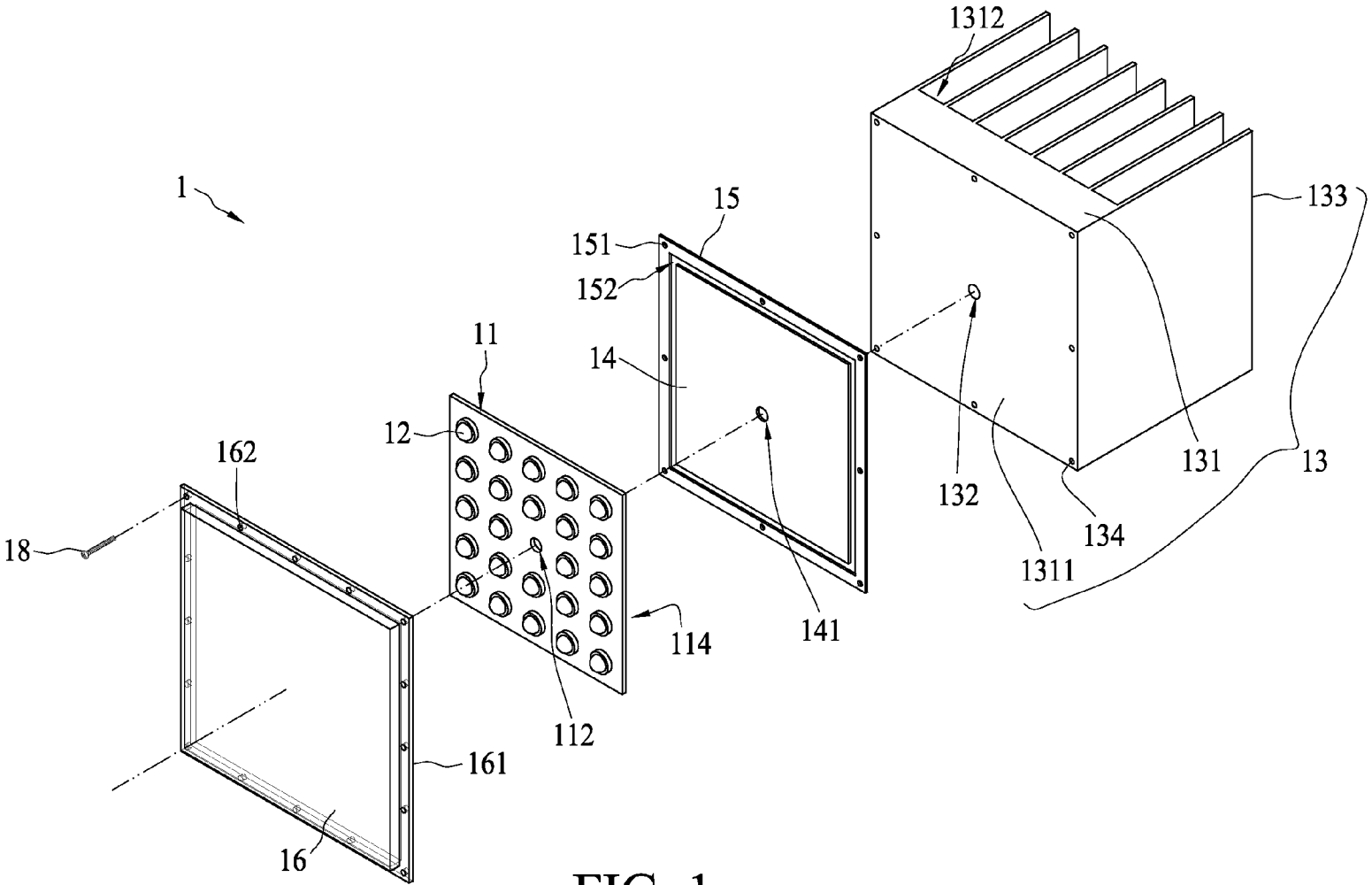
FIG. 1 is an exploded perspective view showing a hermetic light-emitting device according to one embodiment of the present disclosure.
Figure 2:
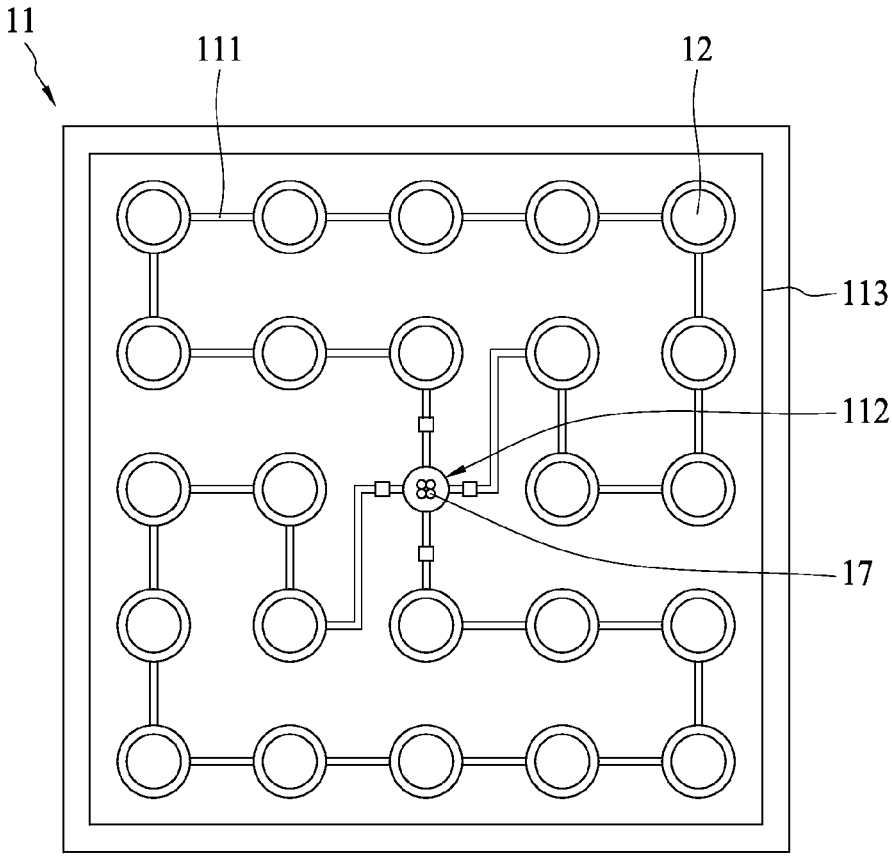
FIG. 2 is a front view showing a circuit substrate according to one embodiment of the present disclosure.

FIG. 1 is an exploded perspective view showing a hermetic light-emitting device 1 according to one embodiment of the present disclosure. FIG. 2 is a front view showing a circuit substrate 11 according to one embodiment of the present disclosure. Referring to FIG. 1, the hermetic light-emitting device 1 of the present embodiment may comprise a circuit substrate 11, at least one light-emitting element 12, a heat dissipation member 13, a thermal interface material (TIM) 14, a first seal pad member 15, and a cover member 16.

As shown in FIG. 2, the circuit substrate 11 may comprise a plurality of conductive traces 111 and a second through-hole 112. The at least one light-emitting element 12 may be disposed on the circuit substrate 11 and electrically connects to the plurality of conductive traces 111. In the present embodiment, the at least one light-emitting element 12 may comprise a plurality of light-emitting elements 12, and the plurality of light-emitting elements 12 may be arrayed and soldered to the circuit substrate 11. In one aspect, the circuit substrate 11 may be of thermal conductive material or highly thermal conductive material. The circuit substrate 11 can comprise a metal core printed circuit board. In another embodiment, the circuit substrate 11 may include an electrically non-conductive substrate with the plurality of conductive traces 111 formed directly thereon, or the circuit substrate 11 may include an electrically conductive substrate, and a dielectric layer 113 can be disposed between the electrically conductive substrate and the plurality of conductive traces 111 for electrical insulation.

Referring to FIG. 1 again, the heat dissipation member 13 may comprise a base portion 131 having a first surface 1311 and a second surface 1312, a first through-hole 132, and at least one fin member 133. The first through-hole 132 can be formed between the first surface 1311 and the second surface 1312 and penetrate through the base portion 131. When the heat dissipation member 13 is disposed adjacent to another substrate surface 114 of the circuit substrate 11, the second through-hole 112 and the first through-hole 132 may be aligned. The at least one fin member 133 can be disposed on the second surface 1312. In the present embodiment, the at least one fin member 133 may comprise a plurality of fin members 133, which are equally spaced on the base portion 131.

The circuit substrate 11 may have favorable or high thermal conductivity. Therefore, the circuit substrate 11, in the present embodiment, can be directly disposed on the first surface 1311 of the heat dissipation member 13 with the at least one light-emitting element 12 positioned opposite to the heat dissipation member 13. In another embodiment, a thermal interface material 14 is disposed between the heat dissipation member 13 and the circuit substrate 11, thereby reducing the thermal resistance between the heat dissipation member 13 and the circuit substrate 11. In the present embodiment, the thermal interface material 14 may comprise a thermal conductive sheet, and the material thereof can be graphite, silica gel, or the like. On the thermal interface material 14, a third through-hole 141 may be formed and aligned with the second through-hole 112 and the first through-hole 132. In another embodiment, the thermal interface material 14 can be a thermal paste.

Referring to FIG. 1, on the first surface 1311 of the heat dissipation member 13, a first seal pad member 15 can be further disposed. The first seal pad member 15 may include a pad opening 152, which is configured so that the circuit substrate 11 can be disposed in the pad opening 152. The first seal pad member 15 may include a sheet-like soft pad or an O-ring. The cover member 16 can be fixed using fixtures 18 with its frame portion 161 being arranged to be against the first seal pad member 15 so that the cover member 16 and the heat dissipation member 13 form an airtight seal. In the present embodiment, the fixture 18 can be a screw, and a plurality of holes 151 and 162 and fixing holes 134 can be separately formed on the frame portion 161, the first seal pad member 15, and the heat dissipation member 13. With the arrangement of the screws and the fixing holes 134, the cover member 16 can be fastened to the heat dissipation member 13. In the present embodiment, the cover member 16 can be transparent.

Figure 3:
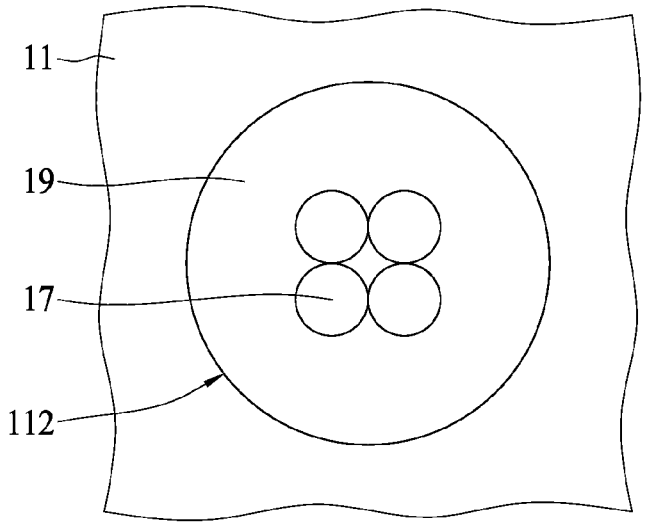
FIG. 3 is a front view showing a first through-hole and a plurality of electrical wires according to one embodiment of the present disclosure.

FIG. 3 is a front view showing a second through-hole 112 and a plurality of electrical wires 17 according to one embodiment of the present disclosure. Referring to FIGS. 1 to 3, the hermetic light-emitting device 1 of the embodiments of the present disclosure can be powered by an external power supply. A plurality of electrical wires 17, electrically connected to the plurality of conductive traces 111, which are included in the circuit substrate 11, pass through the aligned second through-hole 112, first through-hole 132, and third through-hole 141, penetrating through the base portion 131 of the heat dissipation member 13 and extending externally through the plurality of fin members 133 so as to connect to an external power supply. In the second through-hole 112, first through-hole 132, and third through-hole 141 where the electrical wires 17 pass through, a sealing material 19 can be filled, thereby preventing the entrance of moisture into the hermetic light-emitting device 1 via the second through-hole 112 and first through-hole 132. For example, the sealing material 19 can be silica gel, epoxy resin or a similar sealing material.

Figure 4:
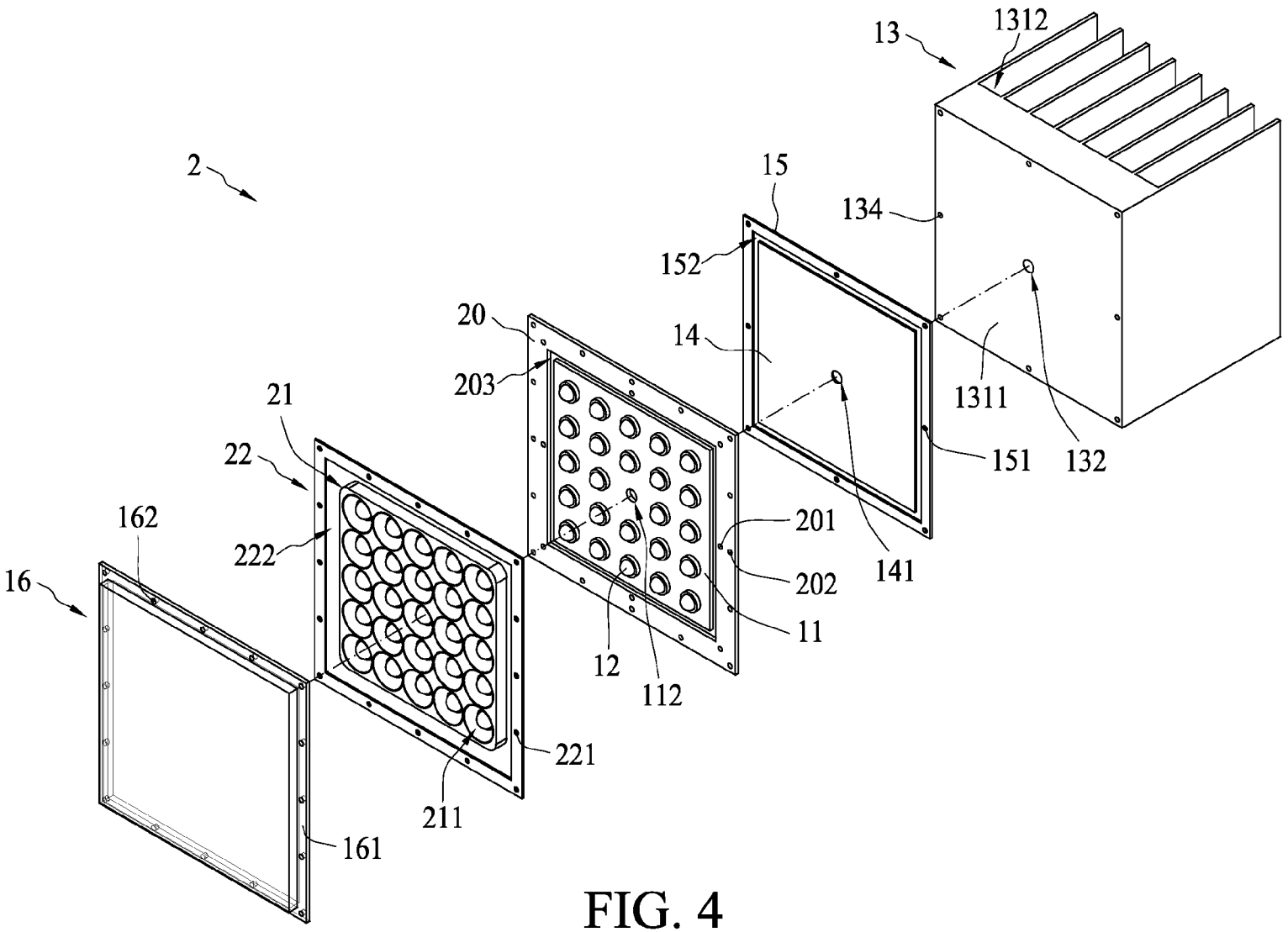
FIG. 4 is an exploded perspective view showing a hermetic light-emitting device according to another embodiment of the present disclosure.

FIG. 4 is an exploded perspective view showing a hermetic light-emitting device 2 according to another embodiment of the present disclosure. The hermetic light-emitting device 2 of the present embodiment may comprise an aforementioned circuit substrate 11, at least one aforementioned light-emitting element 12, an aforementioned heat dissipation member 13, an aforementioned thermal interface material 14, a first seal pad member 15, a frame member 20, a lens assembly 21, a second seal pad member 22, and a cover member 16. The at least one light-emitting element 12 is disposed on a circuit substrate 11 of the circuit substrate 11 and electrically connects to the plurality of conductive traces 111 disposed on the circuit substrate 11. The heat dissipation member 13 is disposed adjacent to another substrate surface of the circuit substrate 11. As in the embodiment shown in FIG. 1, a second through-hole 112 can be disposed on the circuit substrate 11 and a first through-hole 132 can be disposed on the heat dissipation member 13, and the first and second through-holes 132 and 112 can be aligned.

The hermetic light-emitting device 2 may comprise a frame member 20, which can be disposed on the first surface 1311 of the heat dissipation member 13. The frame member 20 can be of metals or non-metals. The frame member 20 can include a frame opening 203, where the circuit substrate 11 can be received. As such, the frame member 20 can surround the circuit substrate 11. Between the frame member 20 and the heat dissipation member 13, the first seal pad member 15 is disposed. A plurality of holes 151 and 201 can be separately and circumferentially formed along the peripheries of the first seal pad member 15 and the frame member 20. On the first surface 1311 of the heat dissipation member 13, a plurality of fixing holes 134, moreover, can be circumferentially formed along the periphery. Using a plurality of fixtures such as the above-mentioned fixtures 18, the frame member 20 and the first seal pad member 15 can be secured to the heat dissipation member 13. Therefore, the frame member 20 and the heat dissipation member 13 can be tightly sealed. In the present embodiment, the first seal pad member 15 may include a pad opening 152, which is configured so that the circuit substrate 11 can be disposed in the pad opening 152. For example, the first seal pad member 15 may be a sheet-like soft pad or an O-ring. In addition, between the circuit substrate 11 and the heat dissipation member 13, a thermal interface material 14 can be disposed. The thermal interface material 14 can be surrounded by the first seal pad member 15. The thermal interface material 14 can further reduce the thermal resistance between the heat dissipation member 13 and the circuit substrate 11.

Referring to FIG. 4 again, the hermetic light-emitting device 2 may comprise a lens assembly 21, which may include at least one lens 211 disposed corresponding to the light-emitting element 12 on the circuit substrate 11. Furthermore, the emission direction of the light beams from each light-emitting element 12 can be changed by the respective lens 211. For example, the lens assembly 21 can cause the light-emitting element 12 to emit beams at an angle between −30 to +30 degrees.

The hermetic light-emitting device 2 may comprise a cover member 16 disposed on the frame member 20. A second seal pad member 22, which may include a pad opening 222 configured so that the lens assembly 21 can be disposed in the pad opening 222, can be disposed between the cover member 16 and the frame member 20. The second seal pad member 22 can facilitate the establishment of a better airtight seal between the cover member 16 and the frame member 20. On the cover member 16, the second seal pad member 22, and the frame member 20, a plurality of holes 162, 221, and 202 for fixing can be separately formed so that the cover member 16, the second seal pad member 22, and the frame member 20 can be fastened together. Specifically, the heat dissipation member 13 and the cover member 16 can be fastened separately to the respective opposite sides of the frame member 20. In between, components such as the lens assembly 21, the light emitting elements 12, and the circuit substrate 11 are disposed so that a complete light emitting module can be established. Using the frame member 20, a plurality of hermetic light-emitting devices 2 can be arrayed on a frame structure such that a light-emitting apparatus for large illumination area can be easily manufactured and the design of new light-emitting apparatuses are unnecessary.

Similar to the embodiment shown in FIG. 1, the hermetic light-emitting device 2 of the present embodiment can be powered through a plurality of wires passing through the second through-hole 112, the first through-hole 132, and the third through-hole 141 and connecting to an external power supply. A sealing material can be filled in the second through-hole 112, the first through-hole 132, and the third through-hole 141 to prevent the entrance of moisture into the hermetic light-emitting device 2.

The embodiments of the present disclosure provide a hermetic light-emitting device, and a plurality of the hermetic light-emitting devices can be easily assembled into a light-emitting apparatus, which can meet any illumination requirement. The redesign of light-emitting devices for different illumination requirements is not required. In addition, the heat dissipation member includes a through-hole used as a passage for wires connected to an external power source such that the compromise of the sealing means can be avoided. The through-hole can be sealed using a sealing material, and such a wiring and sealing arrangement can achieve a better airtight seal.

The above-described embodiments of the present disclosure are intended to be illustrative only. Numerous alternative embodiments may be devised by persons skilled in the art without departing from the scope of the following claims.

We claim:

1. A hermetic light-emitting device, comprising:

a heat dissipation member comprising a first through-hole, at least one fin member, a first surface, and a second surface opposite to the first surface, wherein the at least one fin member is disposed on the second surface, and the first through-hole is formed between the first surface and the second surface;

a circuit substrate including a plurality of conductive traces and a second through-hole disposed corresponding to the first through-hole;

at least one light-emitting element disposed on the circuit substrate and electrically connected to the plurality of conductive traces, wherein the circuit substrate is disposed adjacent to the first surface of the heat dissipation member with the at least one light-emitting element positioned opposite to the heat dissipation member;

a plurality of electrical wires passing through the first and second through-holes, electrically connected to the plurality of conductive traces so as to externally supply electrical power to the at least one light-emitting element;

a sealing material filling the first and second through-holes;

a seal pad member including a pad opening and disposed on the first surface of the heat dissipation member, wherein the circuit substrate is disposed in the pad opening; and a cover member disposed over the at least one light-emitting element and against the seal pad member.

2. The hermetic light-emitting device of claim 1, wherein the at least one light-emitting element is a solid-state light-emitting device.

3. The hermetic light-emitting device of claim 2, wherein the solid-state light-emitting device comprises a light emitting diode.

4. The hermetic light-emitting device of claim 1, further comprising a thermal interface material disposed between the heat dissipation member and the circuit substrate.

5. The hermetic light-emitting device of claim 4, wherein the thermal interface material comprises a thermal conductive sheet.

6. The hermetic light-emitting device of claim 4, wherein the thermal interface material comprises a thermal paste.

7. The hermetic light-emitting device of claim 1, wherein the circuit substrate comprises a metal core printed circuit board.

8. The hermetic light-emitting device of claim 1, further comprising a lens assembly disposed on the at least one light-emitting element and including at least one lens disposed corresponding to the at least one light-emitting element.

9. The hermetic light-emitting device of claim 1, wherein the circuit substrate includes an electrically non-conductive substrate; or the circuit substrate includes an electrically conductive substrate, and the circuit substrate further comprises a dielectric layer disposed below the plurality of conductive traces.

10. A hermetic light-emitting device, comprising:

a heat dissipation member comprising a first through-hole, at least one fin member, a first surface, and a second surface opposite to the first surface, wherein the at least one fin member is disposed on the second surface, and the first through-hole is formed between the first surface and the second surface;

a circuit substrate including a plurality of conductive traces and a second through-hole disposed corresponding to the first through-hole;

at least one light-emitting element disposed on the circuit substrate and electrically connected to the plurality of conductive traces, wherein the circuit substrate is disposed adjacent to the first surface of the heat dissipation member with the at least one light-emitting element positioned opposite to the heat dissipation member;

a plurality of electrical wires passing through the first and second through-holes, electrically connected to the plurality of conductive traces so as to externally supply electrical power to the at least one light-emitting element;

a sealing material filling the first and second through-holes; and a frame member including a frame opening and disposed on the first surface of the heat dissipation member, wherein the circuit substrate is disposed in the frame opening.

11. The hermetic light-emitting device of claim 10, wherein the at least one light-emitting element is a solid-state light-emitting device.

12. The hermetic light-emitting device of claim 11, wherein the solid-state light-emitting device comprises a light emitting diode.

13. The hermetic light-emitting device of claim 10, further comprising a first seal pad member disposed between the frame member and the first surface of the heat dissipation member.

14. The hermetic light-emitting device of claim 13, further comprising a cover member disposed on the frame member and a second seal pad member disposed between the frame member and the cover member.

15. The hermetic light-emitting device of claim 10, further comprising a thermal interface material disposed between the heat dissipation member and the circuit substrate.

16. The hermetic light-emitting device of claim 15, wherein the thermal interface material comprises a thermal conductive sheet.

17. The hermetic light-emitting device of claim 15, wherein the thermal interface material comprises a thermal paste.

18. The hermetic light-emitting device of claim 10, further comprising a lens assembly disposed on the at least one light-emitting element and including at least one lens disposed corresponding to the at least one light-emitting element.

19. The hermetic light-emitting device of claim 10, wherein the circuit substrate comprises a metal core printed circuit board.

20. The hermetic light-emitting device of claim 10, wherein the circuit substrate includes an electrically non-conductive substrate; or the circuit substrate includes an electrically conductive substrate, and the circuit substrate further comprises a dielectric layer disposed below the plurality of conductive traces.

* * * * *